US006929152B2

(12) United States Patent
Bonningue et al.

(10) Patent No.: US 6,929,152 B2
(45) Date of Patent: Aug. 16, 2005

(54) ASSEMBLY FOR THE PACKAGING AND APPLICATION OF A FLUID PRODUCT

(75) Inventors: Philippe Bonningue, Paris (FR); Patrick Uras, Fontenay sous Bois (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 10/830,037

(22) Filed: Apr. 23, 2004

(65) Prior Publication Data

US 2005/0040186 A1 Feb. 24, 2005

Related U.S. Application Data

(60) Provisional application No. 60/470,504, filed on May 15, 2003.

(30) Foreign Application Priority Data

Apr. 23, 2003 (FR) ..... 03 04973

(51) Int. Cl.[7] ..... B67D 5/00
(52) U.S. Cl. ..... 222/82; 83/207; 83/209
(58) Field of Search ..... 222/82, 83, 207, 222/209

(56) References Cited

U.S. PATENT DOCUMENTS 3,777,941 A * 12/1973 Riddle ..... 222/207
3,812,992 A 5/1974 Wolf et al.
4,258,867 A 3/1981 Weiler et al.
4,696,415 A * 9/1987 Meshberg ..... 222/82
4,898,923 A 2/1990 Katritzky et al.
5,042,690 A 8/1991 O'Meara
5,810,203 A * 9/1998 Brennan ..... 222/209
5,817,082 A 10/1998 Niedospial, Jr. et al.
2003/0168476 A1 * 9/2003 Sanchez ..... 222/321.7

FOREIGN PATENT DOCUMENTS

| | | |
|---|---|---|
| EP | 0328652 | 8/1989 |
| FR | 2236748 | 2/1975 |
| FR | 2811372 | 1/2002 |
| GB | 2249078 | 4/1992 |

OTHER PUBLICATIONS

U.S. Appl. No. 10/379,083, filed Mar. 5, 2003, Sanchez.
U.S. Appl. No. 10/830,037, filed Apr. 23, 2004, Bonningue et al.

* cited by examiner

*Primary Examiner*—Philippe Derakshani
(74) *Attorney, Agent, or Firm*—Oblon, Spivak, McClelland, Maier & Neustadt, P.C.

(57) ABSTRACT

An assembly for the packaging and application of a fluid product in a container. A closure element closes an opening in the container in a manner which is leaktight for the product, with the closure element being fixed on the container by snap-fastening or screwing. An application head can be fixed on the container, and includes; i) an orifice for dispensing the product, which can communicate with the interior of the container; ii) an opening component intended to break the closure element of the container when the head is being fastened onto the container, in order to establish communication between the dispensing orifice and the interior of the container, and iii) a deformable wall which can deform in response to an external pressure exerted on the head, so as to cause the product to be dispensed.

45 Claims, 5 Drawing Sheets

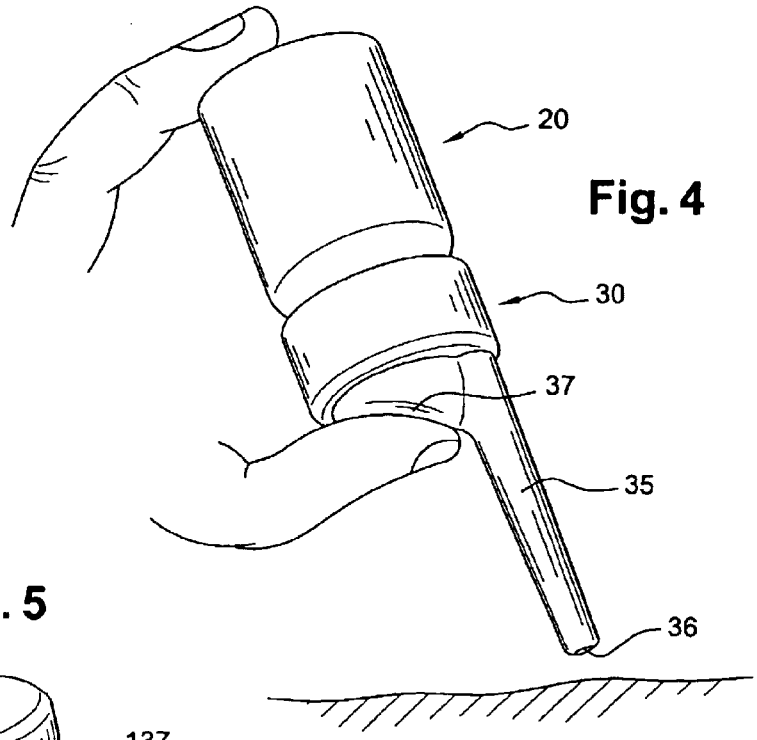
Fig. 4
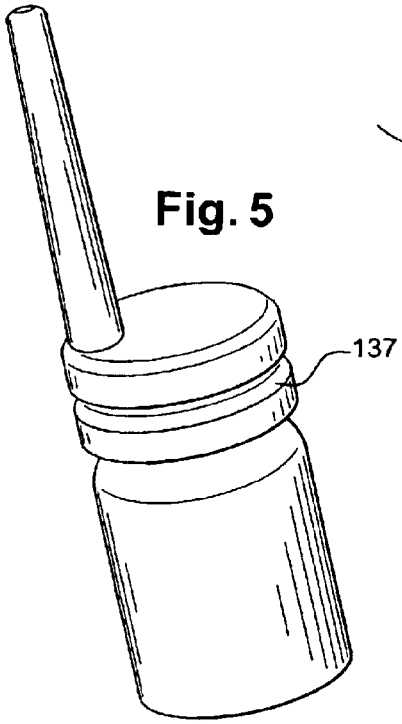
Fig. 5
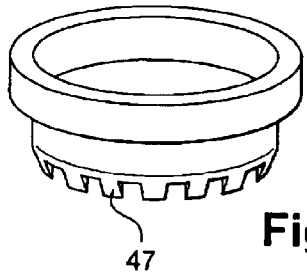
Fig. 6
Fig. 7
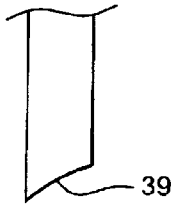
Fig. 8
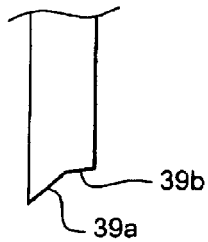

ASSEMBLY FOR THE PACKAGING AND APPLICATION OF A FLUID PRODUCT

CROSS REFERENCE TO RELATED APPLICATIONS:

This document claims priority to French Application Number 03 04973, filed Apr. 23, 2003 and U.S. Provisional Application No. 60/470,504, filed May 15, 2003, the entire contents of which are hereby incorporated by reference.

BACKGROUND OF THE INVENTION

1. Field of the Invention

The present invention relates to an assembly for the packaging and application of a fluid product, and in particular to a device for the packaging and application of a cosmetic, pharmaceutical or dermo-pharmaceutical product. The assembly can be particularly advantageous for use in the packaging and application of a hair product, such as a product to prevent hair loss.

2. Discussion of Background

Products intended to prevent hair loss are applied in the form of several doses, which are applied at successive time intervals. Such products may be packaged in breakable vials, for example glass vials. There is, however, a risk of injury when the vial is being broken, as well as during application of the product since the broken end of the vial, which may be sharp, is placed in contact with the scalp.

These products may alternatively be packaged in small bottles, on which a plastic dispenser head is removably fixed. With this arrangement, it is desirable for the head to be capable of being fitted easily on a bottle, then removed from the bottle in order to be fixed on another bottle corresponding to another dose.

In other application fields, packaging and application assemblies are known which are formed by a container, on which an application head is fixed. For example, GB 2 249 078 describes a container containing a fluid product such as paint, onto which an application head is screwed. With this arrangement, the head is screwed onto the container when it is already open. It is therefore necessary to open the container beforehand if it is closed, and then to screw on the head, which makes it necessary to perform two separate operations.

FR 2 811 372, U.S. Pat. No. 5,042,690 and U.S. Pat. No. 4,898,923 describe application devices formed by a container which is closed in a leaktight fashion by a closure element and on which an applicator head is fixed. In these arrangements, the container is opened when installing the head, which perforates the closure element. All these documents, however, describe containers whose opening is closed by a membrane or a heat-sealed or welded film. The manufacturing cost of these containers closed in this way is relatively high.

FR 2 236 748 describes a dispensing head screwed onto the neck of a tube, which is initially closed by a cap formed integrally with the neck of the tube. The head has a cutting element to pierce the cap when the head is being screwed onto the neck of the tube. The head also has a detachable ring at its bottom. This ring bears against the shoulder of the tube and keeps the cutting element away from the cap. Before first use, the ring is torn off from the rest of the head so that the head can continue to be screwed onto the neck until the cutting element reaches the cap, so as to cause the cap to be pierced. In order to dispense the product, it is necessary to press on the walls of the tube so as to squeeze the product into the head and deliver it through dispensing orifices provided on the head. With such a configuration, it can be difficult to control the flow of the product out of the head.

U.S. Pat. No. 3,812,992 describes a baby bottle formed by a container, on top of which there is a teat. The container is initially closed by a metal cap which is crimped onto the neck of the container. In addition, a seal is compressed between the cap and the neck in order to improve the leaktightness. Here again, the manufacturing cost of these containers closed in this way is relatively high. Furthermore, a hollow cutting tip is provided inside the teat in order to pierce the cap, substantially all around its periphery, when the teat is being screwed onto the bottle. Since the tip extends over 360°, significant friction is generated when screwing the teat onto the bottle. In addition, such a device is not suitable or readily adaptable for applying some of the product onto a person's head.

U.S. Pat. No. 5,817,082 describes a container for pharmaceutical products. The container is closed by an elastomeric stopper, on top of which is provided a head having a central tip through which a channel passes. The tip pierces the stopper at a point. The product is then dispensed through the tip by gravity when the container is inverted. Here again, such a device does not make it possible to apply the product while easily or reliably controlling the product flow.

SUMMARY OF THE INVENTION

It is therefore one of the objects of the invention to produce a packaging and application assembly which does not have the drawbacks of the prior art.

It is another object of the invention to provide an applicator assembly that can be produced at a low cost.

It is yet another object of the invention to provide a packaging and application assembly which is simple to use.

It is still another object of the invention to provide an assembly in which the head can be used several times in the same way, on a plurality of containers.

It is another object of the invention to provide a packaging and application assembly which makes it possible to apply the product in a precise and straightforward way.

It is yet another object of the invention to provide an assembly which is compact, such that the assembly is suitable for small product doses.

It is a further object of the invention to produce a small assembly having ergonomics suitable for use with one hand.

The invention therefore relates to an assembly for the packaging and application of a fluid product. According to an illustrated example, the assembly includes a container having a free edge defining an opening. A closure element or cover is provided to close the opening in a manner which is leaktight for the product, with the closure element being fixed on the container, for example, by snap-fastening or screwing. The assembly also includes an application head which can be fixed on the container. In a preferred arrangement, the application head includes:

i) a dispensing orifice which can communicate with the interior of the container;

ii) an opening component intended to break the closure element of the container when the head is being fastened onto the container, in order to establish communication between the dispensing orifice and the interior of the container; and iii) a deformable wall which can deform in response to an external pressure exerted on the head, so as to cause the product to be delivered.

Where the closure element of the container is snap-fastened or screwed on, the assembly can be produced much more straightforwardly or conveniently than when the container is closed by a heat-sealed membrane.

According to one of the advantageous aspects, the user performs only a single operation in order both to fix the head on the container and to open the container, so that the packaging and application assembly is relatively easy to use.

The head can have a screw thread used for fastening the head onto the container. It is therefore easy to fix the head on the container and to remove the head from the container for subsequent use. Alternatively, the head can be fixed on the container by snap-fastening. The deformable wall of the head can be, for example, a convex wall or a bellows.

The head can be formed, for example, by molding from a single piece. It can be obtained by molding from a single piece, particularly in a single material, or alternatively the deformable wall may be produced by over-molding, in particular by bi-injection molding, of an elastomeric material. An assembly can thus obtained which has a small number of parts, and which can therefore be produced at a low cost. In fact, in an illustrated example, the assembly can be formed of only three parts: the container, the closure capsule and the head.

The head can include a nozzle, at the end of which the orifice for dispensing the product is formed. With this arrangement, it is possible to apply the product in a precise way. The nozzle can be off-centered on the head. This arrangement can be advantageous in that it is thereby more convenient to provide space, particularly along the axis of the nozzle, in order to produce a deformable wall large enough to make the product flow.

The closure opening component can be in the form of a blade. The blade can be formed as an axial extension of one wall of the nozzle, so as to avoid increasing the size of the assembly and furthermore to facilitate mould release of the head. A relatively compact assembly is thus obtained.

The closure element can include a weakened region which can break when the opening component is being engaged with the closure element.

The closure element can be made of a single material. Alternatively, the closure element can be made of two materials. The closure element can, for example, have a fastening flange made of a rigid or semi-rigid thermoplastic material and a central part obtained by injection of an elastomeric material. The closure element can also include a fastening flange made of a rigid or semi-rigid thermoplastic material and a central part formed by a film, for example of aluminum, welded onto the fastening flange.

The edge of the container and/or the closure element can include an anti-rotation arrangement intended to limit the rotational movement of the closure element relative to the container. The edge of the container may, for example, have asperities which engage with asperities formed on the closure element.

The container can have a recess or concave base in order to facilitate positioning of the thumb. The ease of the application procedure is thereby improved.

Thus, the invention can provide an assembly for the packaging and application of a fluid product. The arrangement can include a container having a free edge defining an opening, and a closure element intended to close the opening in a manner which is leaktight for the product. The closure element is preferably fixed on the container by snap-fastening or screwing. The arrangement further includes an application head which can be fixed on the container, with the head preferably including:

i) a nozzle, at the end of which a dispensing orifice is formed which can communicate with the interior of the container, with the nozzle being off-centered on the head; and ii) an opening component intended to break the closure element of the container when the head is being fastened onto the container, in order to establish communication between the dispensing orifice and the interior of the container.

The assembly according to the invention is particularly advantageous for use in for the packaging and application of a cosmetic product, particularly a hair product, such as a product containing alcohol-based compounds.

BRIEF DESCRIPTION OF THE DRAWINGS

The invention will become further apparent from the following detailed description, particularly when considered in conjunction with the drawings in which:

FIG. 4 illustrates the packaging and application assembly of FIG. 1 during use;

FIG. 5 illustrates a second embodiment of a packaging and application assembly according to the invention;

FIG. 6 illustrates a variant of the capsule or cover of the bottle;

FIG. 7 illustrates an example of a component for opening the capsule; and

FIG. 8 illustrates a variant of the component for opening the capsule.

DETAILED DESCRIPTION OF THE PREFERRED EMBODIMENTS

Figure 1:
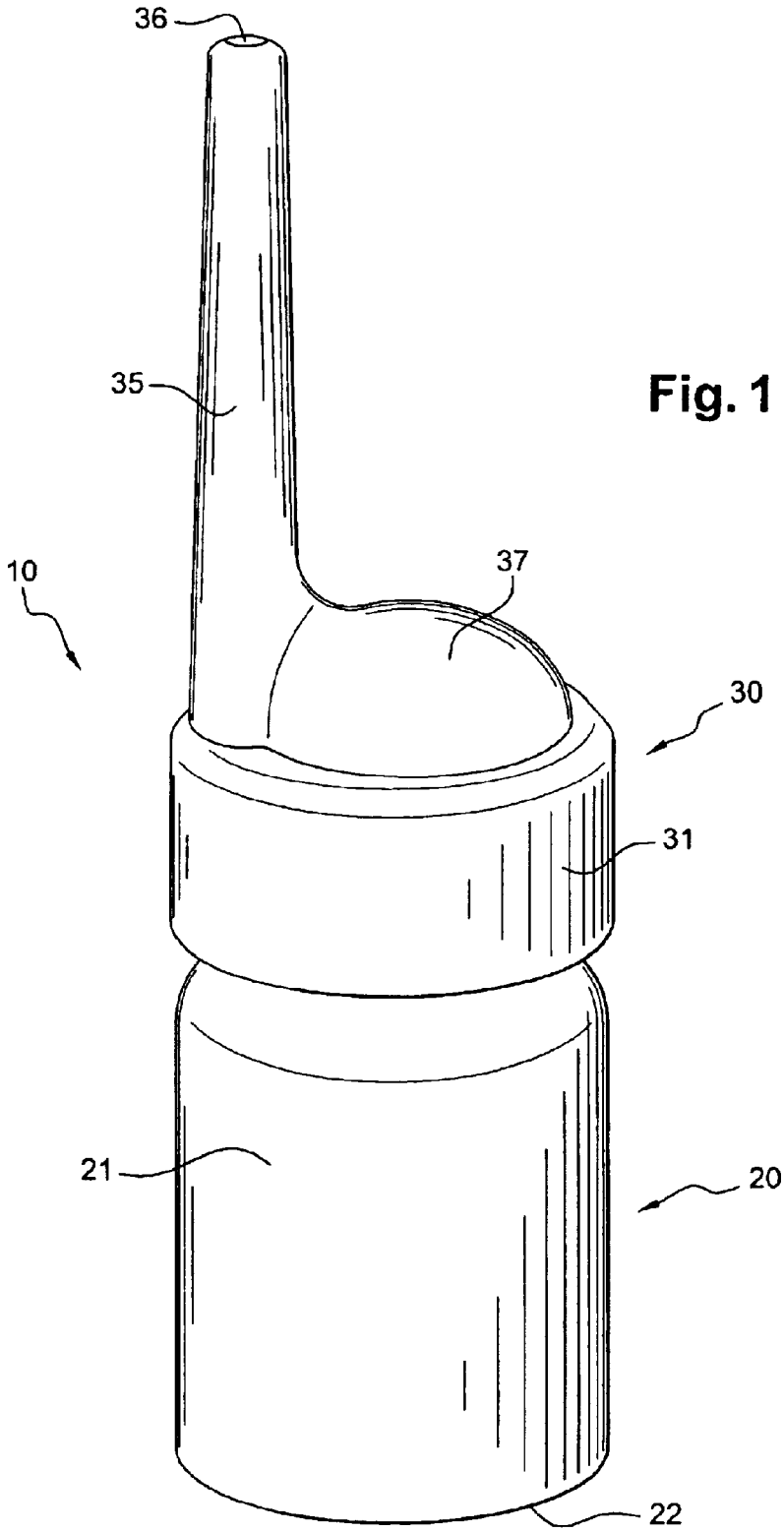
FIG. 1 illustrates a perspective view of a packaging and application assembly according to the invention.

Referring to FIGS. 1 to 4, an example is illustrated of an assembly 10 according to the invention for the packaging and application of a liquid product. The invention is particularly advantageous for liquids used to prevent hair loss. The assembly 10 includes a container 20, on top of which is disposed on an applicator head 30.

By way of example, the container 20 is in the form of a rigid bottle made of a thermoplastic material, for example PET. Alternatively, a bottle made of glass may be used. The bottle has, for example, a capacity of 6 ml. The bottle has a longitudinal axis X and includes an axisymmetric side wall 21, one end of which is closed by a base 22. The base 22 is, for example, a concave or recessed wall intended to facilitate positioning of the thumb or another finger. The second end of the bottle ends in a free edge 23, which defines an opening 24.

In order to fasten the applicator head 30 onto the bottle, the bottle has a screw thread 25 on its outer surface, close to the free edge 23, which is intended to interact with a complementary screw thread provided on the inner surface of the applicator head.

Between the screw thread 25 and the free edge 23, the outer surface of the bottle in the illustrated example has striations 26, the function of which will be explained below, and which extend parallel to the axis X. The striations 26 may extend over only a part of the periphery of the bottle, for example over two diametrically opposite annular portions on the bottle. Alternatively, the bottle may have striations over its entire periphery.

The bottle also has an annular groove 27, which is formed between the striations 26 and the screw thread 25 and which, as discussed further below, makes it possible to fasten a capsule 40 onto the bottle.

The applicator head 30 is arranged to be screwed onto the neck of the bottle. To that end, the head has a fastening flange 31 provided with a screw thread 32 on its inner periphery, which interacts with the screw thread 25 of the bottle. Alternate arrangements can be provided for fastening or coupling the head to the bottle. For example, the head can be fixed on the neck of the bottle by snap-fastening.

Figure 3A:
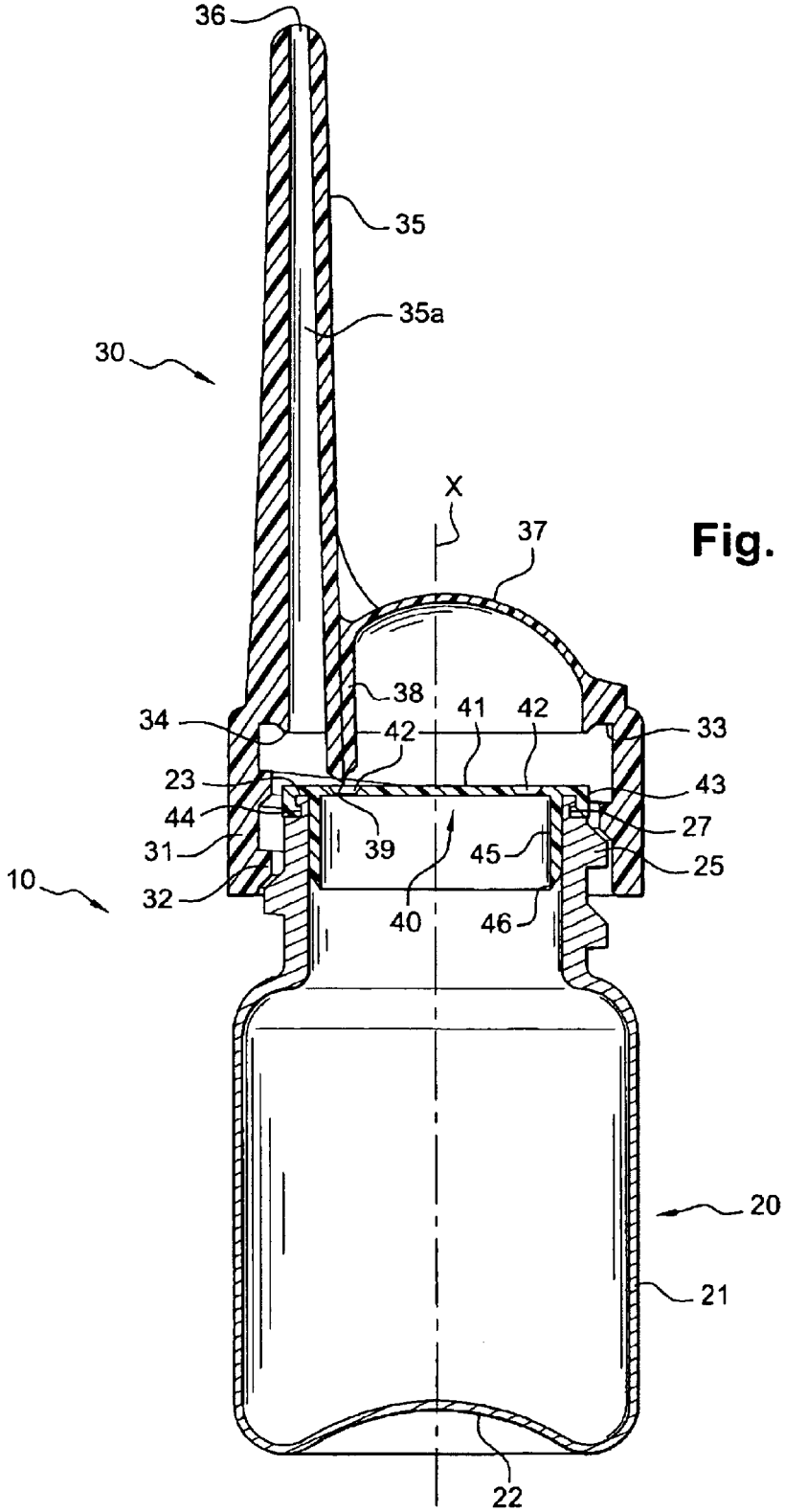
FIG. 3A represents the packaging and application assembly of FIG. 1 in cross-section, when the application head is being fixed on the container.
Figure 3B:
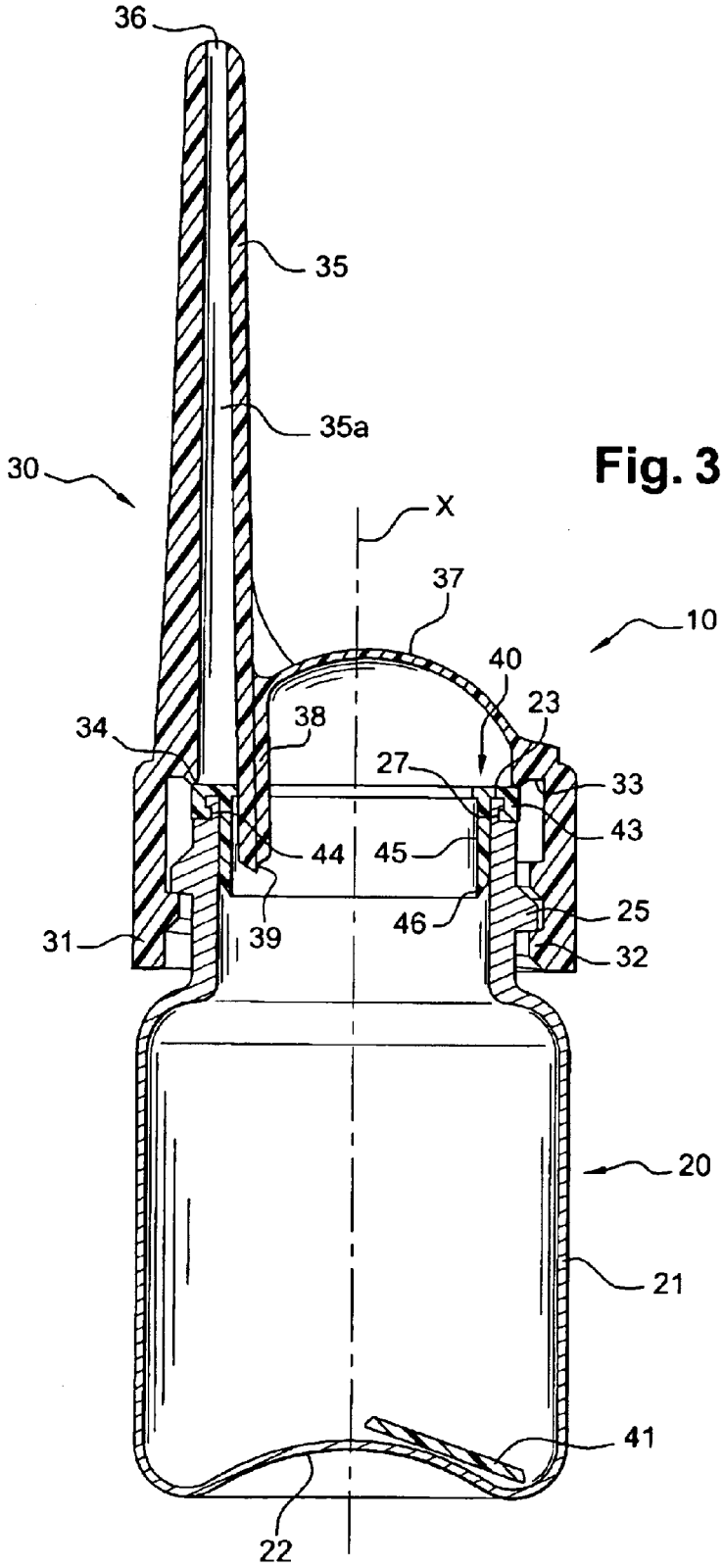
FIG. 3B represents the packaging and application assembly of FIG. 1 in cross-section, when the application head is mounted on the container.

The upper part of the flange 31 has a radial shoulder 33 provided with a sealing ring 34 intended to bear on the capsule 40 in a leaktight fashion, as shown in FIG. 3B.

Beyond this shoulder, the fastening flange is extended by a nozzle 35 delimiting an internal channel 35*a*. The free end of the nozzle opens into an orifice 36 for dispensing the product. The nozzle is formed on one edge of the head, in an off-centered fashion with respect to the axis X. The dimensions of the internal channel 35*a* can be selected according to the viscosity of the product, preferably so as to prevent the product from flowing simply under the effect of gravity.

The fastening flange 31 is also closed by a convex wall 37 in its upper part. The convex wall 37 is capable of deforming when a pressure is exerted in a direction parallel to the axis X, so as to be depressed towards the interior of the head. This deformation makes it possible to break the surface tension of the product inside the head, so as to allow the product to flow towards the dispensing orifice 36.

The head 30 also has an opening component 38 used to break a capsule or cover 40, described below, which closes the opening 24 in a leaktight fashion before the bottle is used. The opening component is a blade 38, which in the illustrated embodiment extends parallel to the axis X as far as a free edge 39 towards or into the bottle. The blade 38 is slightly curved so as to follow the contour of the periphery of the fastening flange 31. In the illustrated arrangement, the blade 38 extends over a portion of a circular arc. As can be seen in FIG. 3A, the free edge 39 of the blade is beveled in order to facilitate its insertion into the capsule 40. In the illustrated example, the free edge 39 is also inclined with respect to the plane of the capsule to be broken, as can be seen in FIG. 7, so as to come progressively in contact with or progressively penetrate the capsule.

According to a variant which is illustrated in FIG. 8, the free edge 39 has two parts inclined with two different slopes. As shown in FIG. 8, this arrangement includes, a substantially inclined first part 39*a*, which is intended to initiate the cutting of the capsule, and a second part 39*b*, which is less inclined than the first, for finishing off the cutting.

In order to limit the size of the assembly while producing a sufficiently large deformable wall, the blade 38 can be at least partially axially aligned or formed as an axial extension of one wall of the nozzle. This arrangement also facilitates mould release of the nozzle.

The screw threads 25 and 32 preferably have a shallow slope in order to further improve the cutting, preferably so that the head requires more than one turn in order to be screwed home when it is being screwed onto the bottle. The capsule or cover is therefore cut gradually, to better ensure the capsule is cut sufficiently in order to free the opening of the bottle.

The head can be advantageously obtained by molding from a single piece. It may be made, for example, of a single thermoplastic material, in particular a polyethylene, a polypropylene, a polyethylene terephthalate, a polyvinyl chloride, a polyamide. Alternatively, the convex wall 37 may be over-molded onto the rest of the head, with the wall 37 made for example of an elastomeric material, in particular rubber, for example Santoprene®. A head which is washable can be obtained in both cases, so that it can be used several times.

According to a variant which is represented in FIG. 5, the convex wall 37 may be replaced by a bellows 137. For example, such a bellows can be formed by a pleated flexible arrangement.

Before the applicator head 30 is fixed on the bottle, the bottle is closed by a capsule 40 made for example of a thermoplastic material, for example PET. In the illustrated example, the capsule is snap-fastened onto the neck of the bottle. Alternatively, the capsule 40 could be screwed onto or into the bottle.

In the illustrated arrangement, the capsule 40 is formed by a circular wall 41, which includes a weakened region 42 intended to be cut. The weakened region 42 extends along a circle which, preferably, lies close to the periphery of the capsule so that almost the entire opening 24 of the bottle can be freed. The weakened region 42 can be formed by a circular portion of the wall 41 which has a smaller thickness than the rest of the wall. Instead of having a smaller thickness all along the circle, the weakened region may have a variable thickness, for example which varies in a crenellated fashion. The thickness may vary repetitively between two values along the circle: a first value corresponding to the thickness of the wall 41 and a smaller thickness second value.

Beyond the portion 42 with a lower thickness, the circular wall 41 is extended by a fastening flange 43 which extends axially and, on its inner surface, has an annular bead 44 intended to be accommodated in a groove 27 of the bottle. The fastening flange 43 also has striations (not shown in the figures) on its inner surface, which are intended to engage with the striations 26 of the bottle. This arrangement provides an example of anti-rotation means which make it possible to limit the rotational movement of the capsule on the bottle. Other forms of asperity or antirotation coupling other than striations which could fulfill this anti-rotation function can be provided on the capsule and/or on the bottle. By way of example, as an alternative or in addition, the internal diameter of the fastening flange may be selected in relation to the external diameter of the bottle so that the clamping of the capsule 40 on the bottle limits the rotational movement of the capsule with respect to the bottle.

Figure 2:
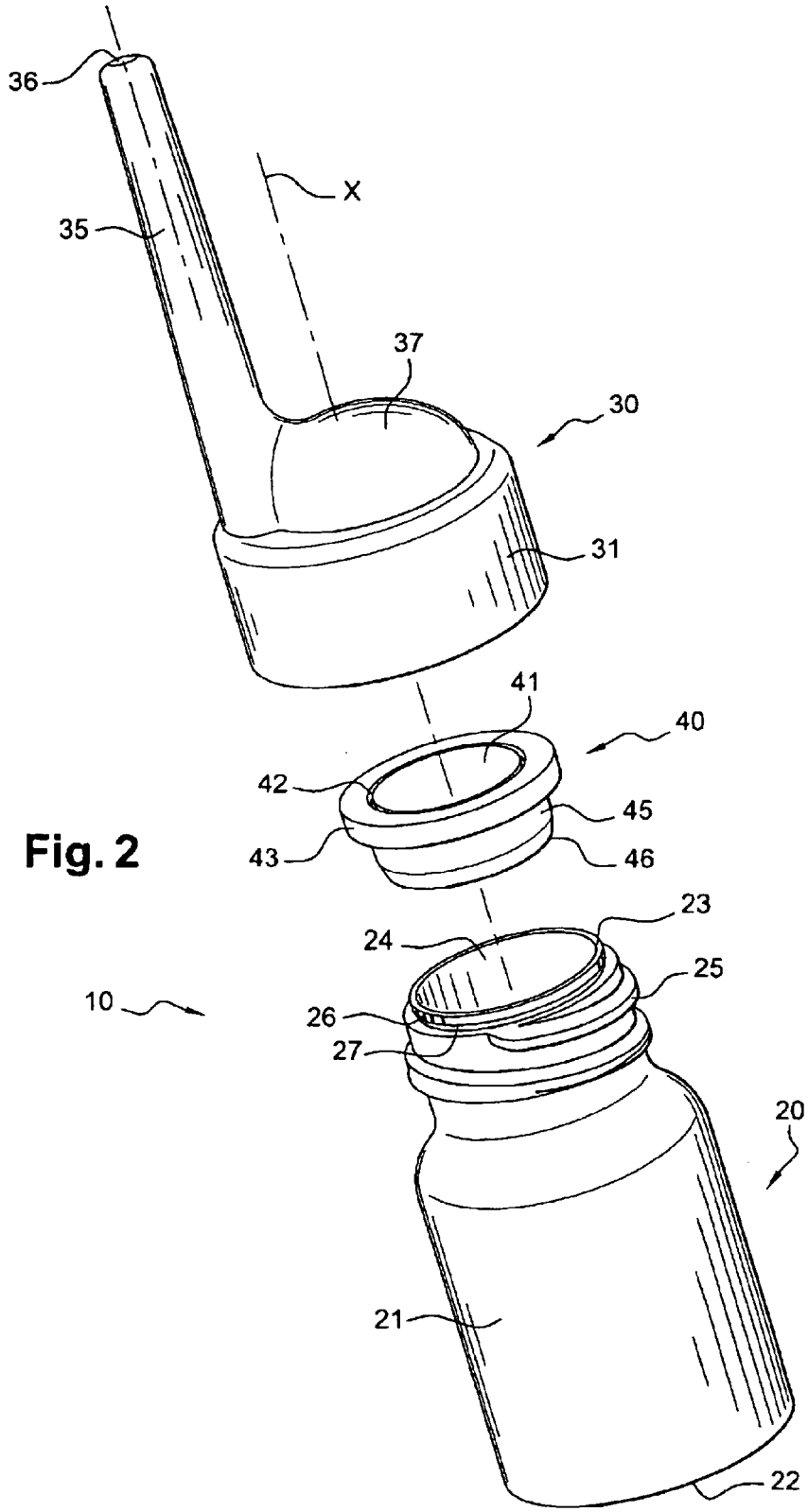
FIG. 2 represents an exploded view of the assembly of FIG. 1.

In the illustrated example, a sealing flange 45, concentric with the fastening flange, is also provided on the capsule. This flange extends axially from the circular wall 41, between the region 42 of lower thickness and the fastening flange 43, and to an end lip 46. The flange bears against the inner surface of the bottle in a leaktight fashion. The lip 46 is slightly inclined in the direction of the center of the flange, so as to facilitate insertion and centering of the sealing flange 45 in the neck of the bottle when the capsule 40 is being fastened onto the bottle. Such a shape can also facilitate distribution of the capsules on a production line, in particular by preventing them from stacking up on one another. The end lip 46 is continuous in the example which is illustrated in FIG. 2. According to a variant which is illustrated in FIG. 6, the end lip is formed by tabs 47 which make it possible to obtain a more flexible lip.

By way of example, the capsule 40 can also be formed by molding in a single piece from a thermoplastic material, in particular a polyethylene, a polypropylene, a polyethylene terephthalate, a polyvinyl chloride, a polyamide. The capsule can be made of a single material or, alternatively, the circular wall 41 may be made by bi-injection of an elastomeric material.

According to one variant (not shown), the applicator head 30 need not be screwed directly onto the bottle but instead onto the capsule 40, which then has a screw thread on its outer wall. As a further alternative, the head 30 may be snap-fastened onto the bottle.

In order to use the device, the user grips a bottle 20 which is closed by a capsule or cover 40. He fixes the head 30 on the closed bottle, by screwing it onto the neck. While screwing, the capsule remains fixed rotationally with respect to the bottle, for example, due to the presence of the striations on the capsule, which prevent rotational movement of the capsule with respect to the bottle by friction on the striations 26 formed on the bottle. While screwing, the blade 38 engages progressively with the capsule's circular portion 42 having a lower or smaller thickness, as can be seen in FIG. 3A, until this portion is broken. The dispensing orifice is then in communication with the interior of the bottle. When the screwing action is completed, the circular wall 41 of the capsule can be fully detached and fall into the bottle, as has been represented in FIG. 3B. As an alternative, the circular wall 41 may remain connected to the capsule by a small radial portion.

The user can then apply the product by inverting the device and pointing the nozzle towards his scalp. As can be seen in FIG. 4, for example, the user holds the applicator by positioning his thumb on the base of the container and his index finger on the convex wall. He can then bring about delivery of the product by pressing on the convex wall in order to deliver the product. It is sufficient for him to stop pressing in order to stop the flow. The user therefore has better control over the delivery of the product. The assembly obtained in this way is highly ergonomic, and has a miniature shape or small size that is suitable for being used between two fingers. Such an arrangement is very convenient to use. Since the orifice has a small diameter and lies at the end of the nozzle, the product can flow onto the person's head in a highly localized fashion, which makes it possible to apply the product with a great deal of control.

After having applied the contents of the bottle, the user may unscrew the head 30 from the empty bottle with a view to using it again later. Indeed, the head can be re-used in another bottle under the same conditions as during its first use, preferably after having been washed.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. An assembly for packaging and application of a fluid product, comprising:

a container having a free edge defining an opening;

a closure element intended to close the opening in a manner which is leaktight for the product, the closure element being coupled to the container by one of snap-fastening and screwing; and an application head which can be fixed on the container, the application head comprising:

i) a dispensing orifice which can communicate with the interior of the container;

ii) an opening component intended to break the closure element of the container when the application head is being fastened onto the container in order to establish communication between the dispensing orifice and an interior of the container; and iii) a deformable wall which can deform in response to an external pressure exerted on the application head so as to cause the product to be delivered.

2. An assembly according to claim 1, wherein the application head has a screw thread used for fastening the application head onto the container.

3. An assembly according to claim 1, wherein the deformable wall includes a convex wall.

4. An assembly according to claim 3, wherein the deformable wall includes a bellows.

5. An assembly according to claim 1, wherein the application head is a single molded piece.

6. An assembly according to claim 1, wherein the deformable wall is bi-injection molded of an elastomeric material.

7. An assembly according to claim 1, wherein the application head is made of a single material.

8. An assembly according to claim 1, wherein the application head includes a nozzle at the end of which the orifice for dispensing the product is disposed.

9. An assembly according to claim 8, wherein the nozzle is positioned at an off-center location on the application head.

10. An assembly according to claim 9, wherein the opening component includes a blade.

11. An assembly according to claim 10, wherein the blade axially extends from one wall of the nozzle.

12. An assembly according to claim 1, wherein the opening component is in the form of a blade.

13. An assembly according to claim 12, wherein the blade axially extends from one wall of the nozzle.

14. An assembly according to claim 13, wherein the closure element includes a weakened region which can be broken when the opening component is being engaged with the closure element.

15. An assembly according to claim 1, wherein the closure element includes a weakened region which can be broken when the opening component is being engaged with the closure element.

16. An assembly according to claim 1, wherein the closure element is made of a single material.

17. An assembly according to claim 1, wherein the closure element is made of two materials.

18. An assembly according to claim 1, further including anti-rotation means provided on at least one of the container and the closure element to limit the rotational movement of the closure element relative to the container.

19. An assembly according to claim 1, wherein the edge of the container has asperities which engage with asperities formed on the closure element.

20. An assembly according to claim 1, wherein the container has a concave base.

21. An assembly according to claim 1, wherein the container includes a neck, and wherein the closure element includes an inner wall which extends inside of said neck of said container.

22. An assembly according to claim 21, wherein the closure element further includes a flange which extends over a portion of an outer surface of the neck of the container.

23. An assembly according to claim 1, wherein the application head includes a nozzle which terminates at the dispensing orifice, and wherein the opening component is at least partially axially aligned with said nozzle, and further wherein said nozzle is disposed at an off-center location with respect to a longitudinal axis of the container when the application head is mounted on the container.

24. An assembly according to claim 1, wherein a hair product is disposed in said container.

25. An assembly according to claim 24, wherein said hair product is a product which reduces hair loss.

26. An assembly according to claim 1, further including a cosmetic disposed in said container.

27. An assembly for the packaging and application of a fluid product, comprising:

a container having a free edge defining an opening;

a closure element to close the opening in a manner which is leaktight for the product, the closure element being fixed on the container by one of snap-fastening and screwing;

an application head which can be fixed on the container, having i) a nozzle, at the end of which a dispensing orifice is formed which can communicate with the interior of the container, the nozzle being off-centered on the head;

ii) an opening component intended to break the closure element of the container when the application head is being fastened onto the container, in order to establish communication between the dispensing orifice and the interior of the container.

28. An assembly according to claim 27, further including a cosmetic product disposed in said container.

29. An assembly according to claim 27, further including a hair care product disposed in said container.

30. An assembly according to claim 29, wherein said hair care product is a product which reduces hair loss.

31. An assembly according to claim 27, wherein at least a portion of the opening component is axially aligned with a portion of said nozzle.

32. An assembly according to claim 31, wherein the application head includes a deformable portion which can deform in response to an external pressure exerted on the application head so as to cause the product to be delivered.

33. An assembly according to claim 32, wherein the opening component includes a blade.

34. An assembly according to claim 27, wherein the closure element includes an inner wall which extends inside of the container opening, the closure element further including a flange which extends over the free edge of the container and along a portion of an outer surface of the container.

35. An assembly according to claim 34, further including means to limit rotation of said closure element with respect to said container.

36. An assembly according to claim 34, wherein said application head includes a seal portion which bears against said flange of said closure element, and wherein said opening component is disposed radially inside of said seal portion.

37. An assembly for packaging and application of a fluid product, comprising:

a container having a free end defining an opening;

a closure element which closes the opening in a leaktight manner;

an application head which can be fixed onto the container, the application head comprising:

i) a nozzle extending to a dispensing orifice, said nozzle positioned on said application head such that when said application head is fixed on said container said nozzle is off-centered with respect to a longitudinal axis of said container;

ii) an opening component which breaks the closure element of the container when the application head is being fastened onto the container to establish communication between the dispensing orifice and an interior of the container, wherein at least a portion of the opening component is axially aligned with a portion of said nozzle; and iii) a deformable portion which can deform in response to an internal pressure exerted on the head so as to cause the product to be delivered.

38. An assembly according to claim 37, wherein the closure element includes an inner wall which extends inside of the container opening, the closure element further including a flange which extends over the free edge of the container and along a portion of an outer surface of the container.

39. An assembly according to claim 38, wherein said application head includes a seal portion which bears against said flange of said closure element, and wherein said opening component is disposed radially inside of said seal portion.

40. An assembly according to claim 37, wherein said closure element is coupled to said container by one of snap-fastening and screwing.

41. An assembly according to claim 40, further including means to limit rotation of said closure element with respect to said container.

42. An assembly according to claim 37, wherein said opening component extends axially from a wall of said nozzle.

43. An assembly according to claim 37, further including a cosmetic product disposed in said container.

44. An assembly according to claim 37, further including a hair product disposed in said container.

45. An assembly according to claim 44, wherein said hair product includes a product for reducing hair loss.

* * * * *